US005900115A

United States Patent [19]

Kuroyama et al.

[11] Patent Number: 5,900,115

[45] Date of Patent: May 4, 1999

[54] INK JET RECORDING PAPER

[75] Inventors: Yoshihiro Kuroyama; Teiichi Ohtani; Yukio Kobayashy; Yoichi Yamazaki; Yasunori Nanri, all of Tokyo, Japan

[73] Assignee: Nippon Paper Industries, Co., Ltd., Japan

[21] Appl. No.: 08/853,454

[22] Filed: May 9, 1997

[30] Foreign Application Priority Data

May 10, 1996 [JP] Japan ..... 8-140885

[51] Int. Cl.[6] ..... B41M 5/00; D21F 11/00; D21H 19/12; D21H 19/82

[52] U.S. Cl. ..... 162/135; 162/181.1; 162/181.8; 162/175; 162/164.1; 428/211; 428/340; 428/537.5; 428/341

[58] Field of Search ..... 162/135, 181.1, 162/181.8, 175, 177, 178, 158, 164.1; 428/211, 195, 535, 537.5, 340, 341, 342; 346/135.1, 136

[56] References Cited

U.S. PATENT DOCUMENTS

| | | | |
|---|---|---|---|
| 4,496,629 | 1/1985 | Haruta et al. | 428/341 |
| 4,956,223 | 9/1990 | Arai et al. | 428/212 |
| 5,180,624 | 1/1993 | Kojima et al. | 428/211 |
| 5,541,002 | 7/1996 | Hosoi et al. | 428/537.5 |

FOREIGN PATENT DOCUMENTS

| | | |
|---|---|---|
| 582466 | 8/1992 | European Pat. Off. . |
| 726353 | 8/1996 | European Pat. Off. . |
| 770729 | 5/1997 | European Pat. Off. . |

OTHER PUBLICATIONS

Derwent Abstracts of JP 7,186,519 & U.S. Patent 5,541,002.

Patent Abstracts of Japan of JP 62–095285A.

Patent Abstracts of Japan of JP 08 025799.

*Primary Examiner*—Stanley S. Silverman
*Assistant Examiner*—Jose A. Fortuna
*Attorney, Agent, or Firm*—Millen, White, Zelano, & Branigan, P.C.

[57] ABSTRACT

Provided are an ink jet recording paper which is provided with a recording layer having a coverage rate of from 0.1 to 10 g/m$^2$ on at least one side of a base paper and has a basis weight of from 50 to 100 g/m$^2$, with the recording paper having an irreversible shrinkage factor of from −0.05% to 0.10% in the CD direction when it is put under an environment that the relative humidity thereof is raised to 95% from 35% and then lowered to 35% and further showing a shrinking rate of from 0.15% to 0.25% in the CD direction by the change in relative humidity of the environment from 75% to 60% during the process of lowering the relative humidity from 90% to 35%.

8 Claims, No Drawings

INK JET RECORDING PAPER

FIELD OF THE INVENTION

The present invention relates to an ink jet recording paper on which images are recorded with water base ink and, more particularly, to a ink jet recording paper which is reduced in undulation caused immediately after printing, or the so-called cockling, and undulation due to standing after printing.

BACKGROUND OF THE INVENTION

In an ink jet recording method, recording is carried out by jetting fine drops of ink using a variety of mechanisms so as to adhere to a recording paper, and thereby forming ink dots on the recording paper. Therefore, the recording method of ink jet type has advantages in that it is noiseless, can provide full-color prints with ease and enables high-speed printing, compared with the recording method of dot impact type. However, it also has a weak point that printed ink is hard to dry since the ink used for ink jet recording is usually water base ink.

Thus, the paper used in the ink jet recording method is required to have properties of (1) ensuring high-speed drying of ink, (2) providing prints of high optical density, (3) being free from overflowing and feathering of ink, (4) not causing undulation by the absorption of ink, and so on.

The undulation concerning the required property (4) cited above can be classified into two types, namely the undulation of the type called cockling which is caused immediately after printing by expansion of paper due to absorption of ink and the undulation of the other type which is caused by shrinkage of paper due to drying of ink upon standing after printing.

As a measure against the cockle generation, the methods of using base papers having excellent dimensional stability are disclosed (Japanese Tokkai Sho 62-95285 and Japanese Tokkai Hei 4-91901, wherein the term "Tokkai" as used herein means an "unexamined published patent application"). With respect to the undulation of the latter type, on the other hand, the cause thereof has not yet been cleared up, so that measures which have hitherto been taken are insufficient. However, it has been known that the undulation of the latter type became serious when ink easily permeated into a raw paper because of reduced coverage of the recording layer provided thereon or when the ink jet recording paper comprised of a raw paper having a light basis weight and had low stiffness to be liable to undulation.

Further, it has been known that, even when the cockling trouble was avoided by the use of a base paper having good dimensional stability as described in Japanese Tokkai sho 62-95285, the undulation due to standing after printing often showed a tendency to increase so far as not only the base paper had a light basis weight and low stiffness but also the recording layer had a low coverage rate. Conversely, the recording papers having liability to cockling have been known to hardly suffer from the undulation trouble when allowed to stand after printing.

The aforementioned knowledge means that whether or not the recording paper causes cockles immediately after printing depends largely upon the expansibility thereof, while the undulation due to standing after printing depends primarily upon the irreversible shrinkage factor of the recording paper. In general, there is a tendency that the irreversible shrinkage factor is high in a recording paper which has undergone the so-called tension drying treatment, or a drying treatment under a bound condition, to acquire low expansibility and excellent dimensional stability. Accordingly, the physical properties responsible for the cockling are incompatible with those for the undulation due to standing after printing.

SUMMARY OF THE INVENTION

As a result of our intensive studies of the aforesaid problem, it has been found that the irreversible shrinkage factor and the expansibility were not always fixed intrinsically, but influenced by the history of wetting and drying operations which the paper had undergone, a paper-making condition and so on, and further, when an ink jet recording paper has a specified irreversible shrinkage factor and a specified shrinking rate in the CD direction, both the cockles caused immediately after printing and the undulation due to standing after printing were reduced; thereby achieving the present invention. The term "CD direction" as used herein means the direction crossing at right angles with the paper traveling direction in a paper machine, usually called the cross machine direction.

Therefore, a first object of the present invention is to provide an ink jet recording paper wherein both the cockles caused immediately after printing and the undulation due to standing after printing are very satisfactorily reduced in number and magnitude.

The aforementioned object is attained by an ink jet recording paper which is provided with a recording layer having a coverage rate of from 0.1 to 10 g/m$^2$ on at least one side of a base paper and has a basis weight of from 50 to 100 g/m$^2$; with the recording paper having an irreversible shrinkage factor of from −0.05% to 0.10% in the CD direction when it is put under an environment that the relative humidity thereof is raised to 90% from 35% and then lowered to 35%, and further showing a shrinking rate of from 0.15% to 0.25% in the CD direction by the change in relative humidity of the environment from 75% to 60% during the process of lowering the relative humidity from 90% to 35%.

DETAILED DESCRIPTION OF THE INVENTION

The pulp used for making the base paper of the present ink jet recording paper can be selected properly from those generally used in paper making, such as hardwood- or softwood-made chemical pulp, mechanical pulp and deinked pulp.

The foregoing base paper can contain an internal filler. Such a filler can be selected properly from the fillers generally used for paper-making, e.g., talc, kaolin, calcium carbonate, titanium dioxide and so on.

In general, the higher the freeness of the pulp used is and the greater the amount of a filler used is, the easier it becomes to acquire an adequate balance between the shrinking rate and the irreversible shrinkage factor, but the lower the paper strength and stiffness becomes to result in deterioration of the traveling properties upon printing. Therefore, it is desirable that the freeness be, e.g., from 350 to 450 ml (by Canadian standard) in the case of LBKP and the proportion of a filler in the base paper be from 5 to 15 wt %.

Before the base paper is coated with a recording layer, a water-base coating color containing, e.g., water, a water-soluble or water-dispersible polymer or/and pigments can be applied to at least one side of the base paper.

As for the water-soluble or water-dispersible polymer usable therein, starch, polyvinyl alcohol, carboxymethyl cellulose, casein, a styrene/butadiene latex, an acrylic emulsion and a vinyl acetate emulsion are examples thereof. As for the pigment usable therein, clay, calcium carbonate, titanium oxide, silica and organic pigments are examples thereof.

In the foregoing water-base coating color, those pigments may be used alone or as a mixture. Such a pigment is mixed with one or more of a water-soluble or water-dispersible polymer, admixed with an auxiliary agent, if needed, and then made into the so-called coating color.

The coating method used in the present invention can be properly selected from the coating methods using known coating machines, such as a blade coater, an air knife coater, a roll coater, a kiss coater, a squeegee coater, a curtain coater, a bar coater, a gravure coater and a comma coater.

Examples of a pigment used in a recording layer of the present ink jet recording paper include amorphous silica, kaolin, calcium carbonate, alumina, aluminum hydroxide, magnesium carbonate, satin white, aluminum silicate, colloidal silica and montmorillonite. Also, these pigments can be used as a mixture of two or more thereof.

Suitable examples of a binder used in the recording layer include casein, soybean protein, starch, polyvinyl alcohol, carboxymethyl cellulose, a styrene-butadiene latex, an acrylic emulsion, a vinyl acetate emulsion and polyurethane. These binders can be used alone or as a mixture of two or more thereof.

To a binder as recited above, various auxiliary agents used for conventional coating colors, such as a dispersing agent, a flowability modifier, a defoaming agent, a dye, a lubricant and a water-holding agent, can be added.

The present recording layer can be formed using a method selected properly from the coating methods using conventional coating machines as recited above with respect to the application of a water-base coating color to a base paper.

The coverage rate of the recording layer can be adjusted arbitrarily as far as it is enough to cover the whole surface of a base paper and ensure sufficient ink absorption. However, in order to effect sufficient reduction in the cockling and the undulation due to standing after printing, the coverage rate of the recording layer is required to be within such a range as to allow of appreciable ink permeation into a base paper, namely within the range of 0.1 to 10 g/m$^2$ per side on a solids basis.

The irreversible shrinkage factor of the recording paper is a determining factor in the undulation due to standing after printing, and it is essential to the present invention that the irreversible shrinkage factor in the CD direction be within the range of −0.05 to 0.10%. On the other hand, the shrinking rate of the recording paper is a determining factor in the undulation caused immediately after printing. Although the nearer this factor is to zero the more effectively the undulation can be reduced in principle, the shrinking rate in the CD direction is required to be adjusted to the range of 0.15 to 0.25% because the present recording paper should be well balanced between the irreversible shrinkage factor and the shrinking rate in order to achieve satisfactory reduction in the two types of undulation.

The irreversible shrinkage factor and shrinking rate in the CD direction required for the present recording paper can be achieved by not only choosing, as mentioned above, the pulp with an adequate freeness and adjusting the filler content to an appropriate value, but also by properly controlling the draw and the drying condition in the paper-making process, wherein the term "draw" is expressed in the percentage of a reel speed to a wire part speed, and subjecting the thus made paper to a wetting-and-drying operation and a coating operation as a proper tension is applied thereto by reeling the paper at a speed slightly different from an unreeling speed (the tension of this type is also called "draw" and defined by the equation, [(reeling speed—unreeling speed)/unreeling speed]×100%).

Moreover, the present invention can fully achieve its effects when the recording paper has a basis weight of from 50 to 100 g/m$^2$.

More specifically, the ink jet recording paper according to the present invention can be prepared by applying a coating color at a coverage rate of from 0.1 to 10 g/m$^2$ on at least one side of a base paper, which is controlled so as to have a proper irreversible shrinkage factor and a proper shrinking rate and has a basis weight of from about 40 g/m$^2$ to about 100 g/m$^2$, as a proper draw is imposed on the base paper, thereby forming a recording layer, and then drying the recording layer as a proper draw is applied thereto so as to acquire the irreversible shrinkage factor of from −0.05 to 0.10% in the CD direction and the shrinking rate of from 0.15 to 0.25% in the CD direction.

The present ink jet recording paper thus prepared is significantly reduced in cockles caused immediately after printing, the so-called cockling, and the undulation due to standing after printing since it has the irreversible shrinkage factor and the shrinking rate within the ranges specified individually.

The present invention will now be illustrated in more detail by reference to the following examples. However, the invention should not be construed as being limited to these examples. Unless otherwise noted, all "%" and all "parts" in the examples are by weight.

EXAMPLE 1

Preparation of Coating Color for Recording Layer

A water-base coating color having a solids concentration of 30% was prepared. Therein, the solids were constituted of 80 parts of synthetic silica (Mizukasil P-78F, trade name, a product of Mizusawa Industrial Chemicals, Ltd.) and 20 parts of precipitated calcium carbonate (Tamapearl 121, trade name, a product of Okutama Kogyo Co., Ltd.) as the pigments, and 25 parts of polyvinyl alcohol (PVA 117, trade name, a product of Kraray Co., Ltd.) as the binder.

Preparation of Coating Color for Backing Treatment

A water-base coating material having a solids concentration of 45% was prepared. Therein, the solids were constituted of a mixture of 90 parts of kaoline (UW-90, trade name, a product of Engelhard M & C Co.) with 10 parts of precipitated calcium carbonate (Tamapearl 121, trade name, a product of Okutama Kogyo Co., Ltd.) as the pigment, and 15 parts of styrene-butadiene latex (SN307, trade name, a product of Sumitomo Naugatuc Co., Ltd.) as the binder.

Preparation of Ink Jet Recording Paper

A paper stock containing as solids components 93 parts of LBKP with a Canadian standard freeness of 430 ml, 7 parts of precipitated calcium carbonate, 0.05 part of a sizing agent (alkylketene dimer), 1.0 part cationized starch, 0.2 part of paper strength reinforcing agent and 0.05 part of a retention aid was adjusted to a concentration of 0.03%, and therefrom a wood-free paper was made using a Fourdrinier multicylinder paper machine under a condition that the wire part speed was adjusted to 550 m/min and the draw was adjusted to 103%. In the size press step of the paper-making process, starch was coated at a dry coverage of 2 g/m$^2$. The thus made wood-free paper had a basis weight of 70 g/m2.

Further, the coating color prepared above for the backing treatment was coated and dried at the coverage of 2 g/m$^2$ on a solids basis on one side of the wood-free paper using a roll coater under the condition that the coating speed was adjusted to 130 m/min and the draw was adjusted to 101%., and successively the coating color prepared above for a recording layer was coated at the coverage of 7 g/m$^2$ on a solids basis on the other side of the wood-free paper using the roll coater under the same condition as described above, and then dried with a hot-air dryer. Further, the thus dried paper was humidified with a steam foil. Thus, an ink jet recording paper according to the present invention was prepared. The recording paper obtained was examined for irreversible shrinkage factor and shrinking rate in the CD direction under the conditions described below, and evaluated with respect to undulation by the methods described below. The results obtained are shown in Table 1.

EXAMPLE 2

Another ink jet recording paper according to the present invention was prepared in the same manner as in Example 1, except that 85 parts of LBKP with a Canadian standard freeness of 410 ml was used in place of 93 parts of LBKP with a Canadian standard freeness of 430 ml, the amount of the precipitated calcium carbonate used was increased to 15 parts, the draw in the paper-making process was changed to 102% and the draw in the coating and drying steps was changed to 103%. The recording paper thus obtained was examined for irreversible shrinkage factor and shrinking rate under the same conditions as in Example 1, and evaluated with respect to undulation by the same methods as in Example 1. The results obtained are also shown in Table 1.

EXAMPLE 3

Still another ink jet recording paper according to the present invention was prepared in the same manner as in Example 1, except that the draw in the paper-making process was changed to 105%, the coating color prepared for the backing treatment was not applied to the wood-free paper and the draw in the coating and drying steps was changed to 101%. The recording paper thus obtained was examined for irreversible shrinkage factor and shrinking rate under the same conditions as in Example 1, and evaluated with respect to undulation by the same methods as in Example 1. The results obtained are also shown in Table 1.

Comparative Example 1

An ink jet recording paper was prepared in the same manner as in Example 1, except that 97 parts of LBKP with a Canadian standard freeness of 300 ml was used in place of 93 parts of LBKP with a Canadian standard freeness of 430 ml, the amount of the precipitated calcium carbonate used was decreased to 3 parts, the draw in the paper-making process was changed to 102% and the draw in the coating and drying steps was changed to 103%. The recording paper thus obtained was examined for irreversible shrinkage factor and shrinking rate under the same conditions as in Example 1, and evaluated with respect to undulation by the same methods as in Example 1. The results obtained are also shown in Table 1.

Comparative Example 2

A wood-free paper having a basis weight of 64 g/m$^2$ was made using the same paper stock as in Example 1 and a Fourdrinier Yankee machine. Therein, the wire part speed was 500 m/min and the draw was adjusted to 104%. Under the same conditions as in Example 1, one side of the thus made wood-free paper was coated with the same coating color for the backing treatment as used in Example 1 and the other side of the wood-free paper was coated with the same coating color for recording layer as used in Example 1. The recording paper thus obtained was examined for irreversible shrinkage factor and shrinking rate under the same conditions as in Example 1, and evaluated with respect to undulation by the same methods as in Example 1. The results obtained are also shown in Table 1.

The measurement conditions and the evaluation criteria employed for examining the properties of the ink jet recording papers prepared in the above Examples and Comparative Examples are described below. In addition, all the irreversible shrinkage factors and the shrinking rates set forth below are those in the CD direction.

Determination of Irreversible Shrinkage Factor

A recording paper sample was placed in an environmental test room wherein the temperature and the humidity were controllable, and the humidity in the room was changed continuously in the order of 50% RH→35% RH→90% RH→35% RH while the temperature is kept at 25° C. The resultant paper sample was examined for the length thereof and the water content therein by means of an extensometer having a water-content measurement function also. Additionally, the time of one cycle (35% RH→90% RH→35% RH) was adjusted to 6 hours. The irreversible shrinkage factor (%) of the thus processed paper is defined as $[(L_1-L_2)/L_0]\times100$, wherein $L_0$ represents the length of the paper under the humidity set at the initial stage (50% RH), $L_1$ represents the length which the paper has at the time when, during the process of moisturization (humidity change; 35% RH→90% RH), the water content in the paper comes to $M_0$ at the humidity of 50% RH, and $L_2$ represents the length which the paper has at the time when, during the process of demoisturization (humidity change; 90% RH→35% RH), the water content in the paper comes to $M_0$.

Determination of Shrinking Rate

A recording paper sample was placed in the same test room as described above, wherein the humidity was changed continuously at the same speed as described above in the order of 50% RH→35% RH→90% RH→35% RH while the temperature is kept at 25° C. The resultant paper sample was examined for the length thereof by means of an extensometer. The shrinking rate (%) which the paper shows in the demoisturization process (90% RH→35% RH) is defined as $[(L_3-L_4)/L_0]\times100$, wherein $L_0$ represents the length of the paper in the humidity set at the initial stage (50% RH), $L_3$ represents the length of the paper in the humidity lowered to 75% RH in the course of demoisturization and $L_4$ represents the length of the paper in the humidity lowered to 60% RH in the course of demoisturization.

Evaluation Method of Undulation

Printing was carried out on a recording paper sample so that a monochromatic solid area alternated with a blank area having the same width as the solid area by the use of a color ink jet printer (BJC-400 J, trade name, a product of Canon Inc.). The extents of two types of undulation caused in the printed sample immediately after printing and after spontaneously drying the printed area were each evaluated in two grades by visual observation. The grade mark ○ indicates that the extent of undulation is negligible small, and the grade mark×indicates that the extent of undulation is too large to be disregarded. Further, the synthetic evaluation of undulation was made by putting together the extents of the two types of undulation.

TABLE 1

| | Strinking Rate (%) in CD Direction | Irreversible Shrinkage factor(%) in CD Direction | Undulation immediately after Printing | Undulation due to Standing after Printing | Synthetic Evaluation of Undulation |
|---|---|---|---|---|---|
| Example 1 | 0.23 | 0.03 | ○ | ○ | ○ |
| Example 2 | 0.18 | −0.04 | ○ | ○ | ○ |
| Example 3 | 0.20 | 0.08 | ○ | ○ | ○ |
| Compar. Ex. 1 | 0.27 | −0.08 | X | X | X |
| Compar. Ex. 2 | 0.17 | 0.12 | ○ | X | X |

What is claimed is:

1. An ink jet recording paper which is provided with a recording layer having a coverage rate of from 0.1 to 10 $g/m^2$ on at least one side of a base paper and has a basis weight of from 50 to 100 $g/m^2$; said recording paper having an irreversible shrinkage factor of from −0.05% to 0.10% in the CD direction and further showing a shrinking rate of from 0.15% to 0.25% in the CD direction, said base paper comprising pulp and a filler, said pulp having a freeness of 350 to 450 ml by Canadian standard.

2. An ink jet recording paper according to claim 1, wherein the base paper has a coating of water-base coating color comprising a pigment and a water-soluble or water-dispersible polymer on at least one side.

3. An ink jet recording paper according to claim 1, wherein the recording layer comprises a pigment and a binder.

4. An ink jet recording paper according to claim 3, wherein the pigment is one or more of a pigment selected from the group consisting of amorphous silica, kaolin, calcium carbonate, alumina, aluminum hydroxide, magnesium carbonate, satin white, aluminum silicate, colloidal silica and montmorillonite.

5. An ink jet recording paper according to claim 3, wherein the binder is one or more of a binder selected from the group consisting casein, soybean protein, starch, polyvinyl alcohol, carboxymethyl cellulose, a styrene-butadiene latex, an acrylic emulsion, a vinyl acetate emulsion and polyurethane.

6. An ink jet recording paper according to claim 1, wherein the proportion of filler in the base paper is 5 to 15 wt. %.

7. A method of preparing an ink jet recording paper according to claim 1, wherein the base paper is made under a draw defined as the percentage of a reel speed to a wire part speed in the range of 102–105% and the recording paper is coated and dried under a draw defined as ((reeling speed—unreeling speed)/unreeling speed)×100% of 101–103%.

8. A method of preparing an ink jet recording paper according to claim 1, wherein the water-base coating color is coated and dried under a draw defined as ((reeling speed—unreeling speed)/unreeling speed)×100% in the range of 101–103%.

* * * * *